US009656463B1

(12) United States Patent
Ernst et al.

(10) Patent No.: US 9,656,463 B1
(45) Date of Patent: May 23, 2017

(54) ADJUSTING INK DROP SIZE ESTIMATES FOR IMPROVED INK USE ESTIMATES

(71) Applicants: Larry M Ernst, Longmont, CO (US); Mikel John Stanich, Longmont, CO (US)

(72) Inventors: Larry M Ernst, Longmont, CO (US); Mikel John Stanich, Longmont, CO (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/198,022

(22) Filed: Jun. 30, 2016

(51) Int. Cl.
*B41J 2/045* (2006.01)

(52) U.S. Cl.
CPC ..... *B41J 2/0456* (2013.01); *B41J 2/04586* (2013.01)

(58) Field of Classification Search
CPC ..... B41J 2/0456; B41J 2/04586; B41J 2002/17569; B41J 2/17566; B41J 2/04551; B41J 2002/17589
See application file for complete search history.

(56) References Cited

U.S. PATENT DOCUMENTS

| | | | |
|---|---|---|---|
| 5,802,420 | A | 9/1998 | Garr et al. |
| 6,151,039 | A | 11/2000 | Hmelar et al. |
| 6,356,359 | B1 | 3/2002 | Motamed |
| 6,601,934 | B1 | 8/2003 | DeBusschere et al. |
| 7,038,812 | B2 | 5/2006 | Hashimoto et al. |
| 7,380,900 | B2 | 6/2008 | Kanda et al. |
| 7,948,644 | B2 | 5/2011 | Carling et al. |
| 7,954,374 | B2 | 6/2011 | Rankin |
| 8,051,016 | B2 | 11/2011 | Ni et al. |
| 8,154,737 | B2 | 4/2012 | Ferlitsch |
| 8,328,305 | B2 | 12/2012 | Sakurai |
| 8,446,638 | B2 | 5/2013 | Ernst et al. |
| 8,734,034 | B2 | 5/2014 | Morovic et al. |
| 8,807,695 | B1 | 8/2014 | Mantell et al. |
| 2006/0279617 | A1* | 12/2006 | Korn ..... B41J 2/0057 347/88 |
| 2006/0290723 | A1 | 12/2006 | Jeong |

(Continued)

OTHER PUBLICATIONS

Xerox, Fiery® Smart Estimator for specialty dry ink, Brochure, retrieved from http://www.efi.com/library/efi/documents/439/efi_fiery_xerox_fse_sdi_ds_en_us.pdf on Mar. 9, 2017.

(Continued)

*Primary Examiner* — Thinh H Nguyen
(74) *Attorney, Agent, or Firm* — Duft Bornsen & Fettig, LLP

(57) ABSTRACT

Embodiments described herein provide determining an ink drop size. One embodiment comprises a system that includes a printhead fluidly coupled to an ink input supply, and a controller to direct the printhead to eject drops of ink of an ink drop type. The system further includes an ink output estimator to estimate an ink output amount ejected from the printhead based on an estimated quantity of the ejected drops of ink of the ink drop type and an estimated size of the drop type, and an ink measurement device to measure an ink input amount provided by the ink input supply to the printhead. The system also includes a correction module to adjust the estimated size of the drop type based on the ink output amount and the ink input amount for a printing operation.

20 Claims, 5 Drawing Sheets

(56) References Cited

U.S. PATENT DOCUMENTS

| | | | | |
|---|---|---|---|---|
| 2007/0024649 | A1* | 2/2007 | Reinten | B41J 2/17566 347/7 |
| 2009/0089192 | A1 | 4/2009 | Ferlitsch | |
| 2009/0244158 | A1* | 10/2009 | Hara | B41J 29/393 347/16 |

OTHER PUBLICATIONS

Xerox, Choose the right controller for your applications and environment, Brochure, retrieved from http://www.xerox.com/digital-printing/latest/IPPSS-01U.pdf on Mar. 9, 2017.

HP, SmartStream Web Press Ink Estimator, Web Page, retrieved from http://www8.hp.com/us/en/commercial-printers/web-presses/ink-estimator.html on Mar. 9, 2017.

HP, HP SmartStream Solutions for HP PageWide Web Presses, Brochure, retrieved from http://h20195.www2.hp.com/v2/GetPDF.aspx/4AA4-7398ENW.pdf on Mar. 9, 2017.

HP,HP T200 and T300 Color Inkjet Web Press—Ink Estimator (v 2.0) Software Patch, Web Page, retrieved from http://h20564.www2.hp.com/hpsc/doc/public/display?docId=c02881284 on Mar. 9, 2017.

Kodak, Kodak Prosper 6000 Presses, Web Page, retrieved from http://graphics.kodak.com/us/en/product/printers_presses/comm_web/prosper_press/plafform/6000/specifications/technical_data/default.htm on Mar. 9, 2017.

Konica Minolta, Colour Coverage Analyser, Brochure, retrieved from http://www.konicaminolta.be/fileadmin/content/be/Solutions/Colour_Coverage_Analyser_BEU3.pdf on Mar. 9, 2017.

Konica Minolta, Applications Production Printing Line-Up, Brochure, retrieved from http://ipex2014.konicaminolta.eu/perch/resources/applicationline-upproductionprinting.pdf on Mar. 9, 2017.

Epson, The Epson LFP Ink Cost Calculator AP, Web Page, retrieved from https://www.epson.eu/lfp-ink-cost-calculator-app on Mar. 9, 2017.

Ricoh, Ricoh Process Director Ink Estimation, Web Page, retrieved from http://info.rpp.ricoh-usa.com/help/index.jsp?topic=%2Fcom.infoprint.rpd.aix.est%2Fest_c_featov.html on Mar. 9, 2017.

Canon, Canon U.S.A. Launches Océ PRISMAproduction Version 5.0, retrieved from https://www.usa.canon.com/internet/portal/us/home/about/newsroom/press-releases on Mar. 9, 2017.

* cited by examiner

ADJUSTING INK DROP SIZE ESTIMATES FOR IMPROVED INK USE ESTIMATES

FIELD

This disclosure relates to the field of printing systems, and in particular, to adjusting ink drop quantity estimates for improved ink use estimates.

BACKGROUND

Entities with substantial printing demands often use a production printer such as a continuous-forms printer that prints on a web of print media at high-speed, such as a hundred pages per minute or more. A production printer typically includes a print controller that controls the overall operation of the printing system, and a print engine that physically marks the web. The print engine has one or more printheads each with rows of small nozzles that discharge ink as controlled by the printhead controller. During printing, the printheads and the recording medium move relative to one another as ink is ejected at appropriate times to form a printed image in accordance with image data.

Operators and customers of production printing system may desire an accurate estimation of printing costs prior to printing. Since a production printer may handle a print job having hundreds or even thousands of documents, the amount of ink that is to be used for printing may constitute a large cost component in an estimated price quotation for a customer's print job. Inaccurate ink use estimations may cause a printer to lose highly competitive jobs if ink use estimations are too high or consistently inaccurate.

Some print systems estimate ink usage assuming a constant volume of ink drops ejected from the printhead. However, ink volumes ejected by the printhead tend to vary over time and during the course of printing due to changes in the print environment or conditions of the ink or printhead. Accordingly, ink estimates that assume constant ejection amounts are inaccurate, particularly for large print jobs (e.g., ten thousand feet of printing or more).

SUMMARY

Embodiments described herein adjust ink drop size estimates for improved ink estimates. An ink measurement device may obtain accurate amounts of ink supplied to a printhead and help track how the ink is used (e.g., printed page, flushing, cleaning, maintenance, etc.). Information from the ink measurement device may be compared with ink estimates that are based on a rasterization of individual pages in a print job. Repeated comparisons calibrate subsequent ink estimates. Each estimate may be calibrated at the print job level so that a total ink estimate for a print job is highly accurate and estimates for specific pages or parts of the job are also accurate.

One embodiment comprises a system that includes a printhead fluidly coupled to an ink input supply, and a controller to direct the printhead to eject drops of ink of an ink drop type. The system further includes an ink output estimator to estimate an ink output amount ejected from the printhead based on an estimated quantity of the ejected drops of ink of the ink drop type and an estimated size of the drop type, and an ink measurement device to measure an ink input amount provided by the ink input supply to the printhead. The system also includes a correction module to adjust the estimated size of the drop type based on the ink output amount and the ink input amount for a printing operation.

The above summary provides a basic understanding of some aspects of the specification. This summary is not an extensive overview of the specification. It is intended to neither identify key or critical elements of the specification nor delineate any scope particular embodiments of the specification, or any scope of the claims. Its sole purpose is to present some concepts of the specification in a simplified form as a prelude to the more detailed description that is presented later.

DESCRIPTION OF THE DRAWINGS

Some embodiments are now described, by way of example only, and with reference to the accompanying drawings. The same reference number represents the same element or the same type of element on all drawings.

DESCRIPTION

The figures and the following description illustrate specific exemplary embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
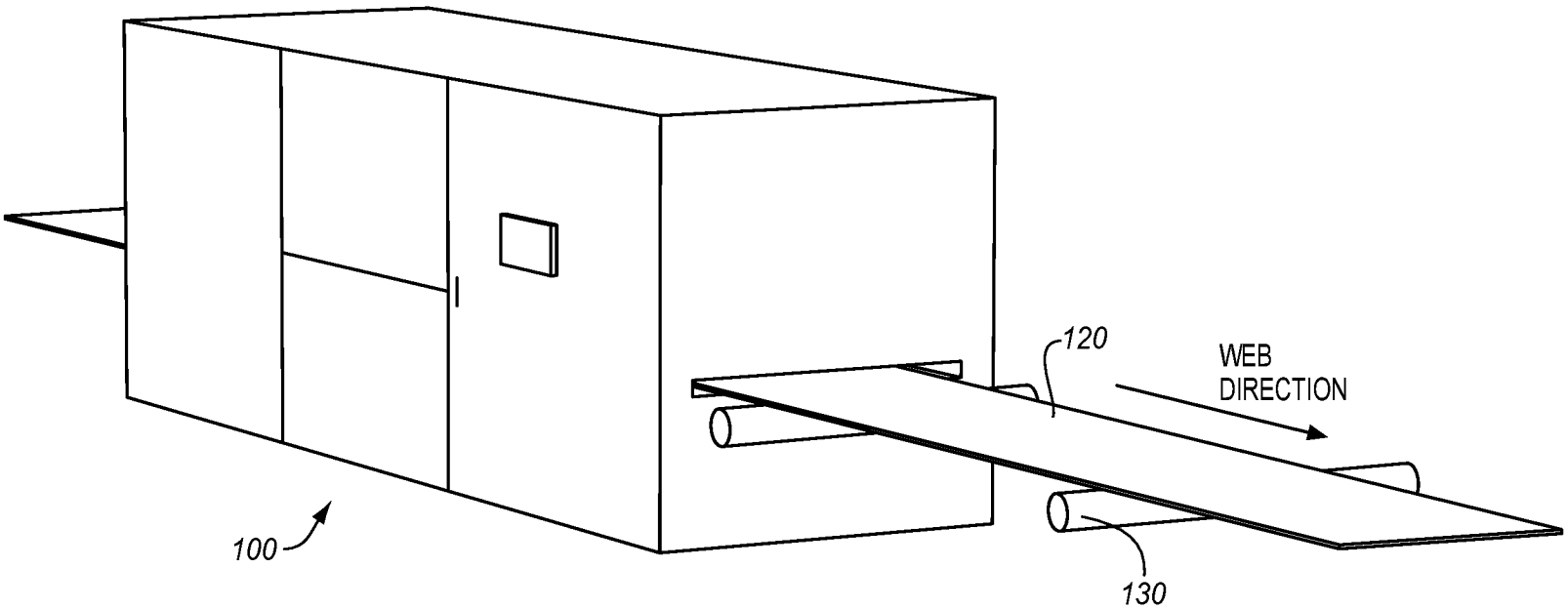
FIG. 1 illustrates an exemplary continuous-forms print system.

FIG. 1 illustrates an exemplary continuous-forms print system 100. Continuous-forms print system 100 is operable to apply ink onto a web 120 of continuous-form print media (e.g., paper). Ink may comprise any suitable marking fluid (e.g., aqueous inks, oil-based paints, additive manufacturing materials, etc.) for marking web 120. One or more rollers 130 position and tension web 120 as it travels through continuous-forms printing system 100.

Figure 2:
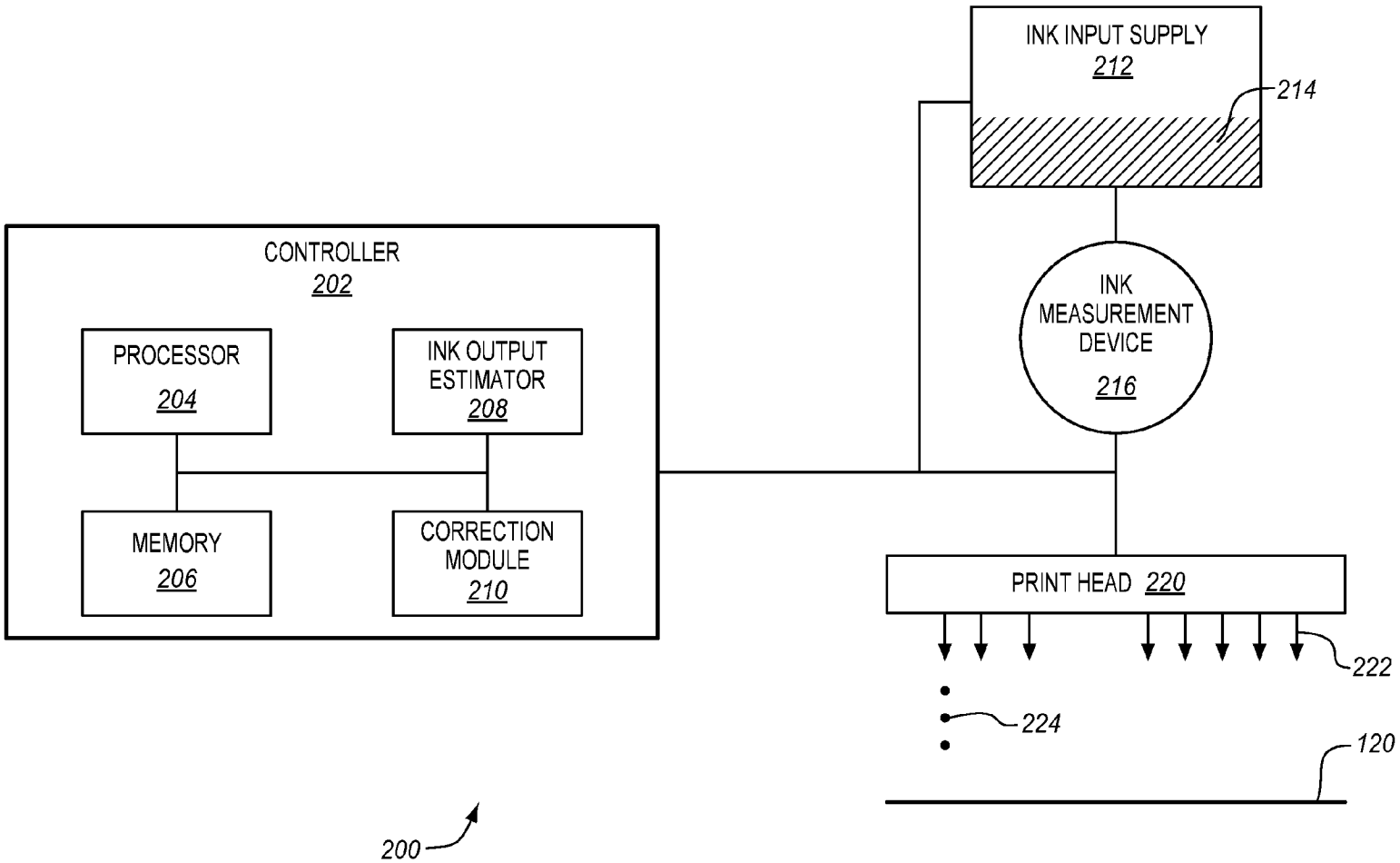
FIG. 2 is a block diagram of a print system in an exemplary embodiment.

FIG. 2 is block diagram of a print system 200 in an exemplary embodiment. Print system 200 may be operable with continuous-forms print system 100 or other types of printers and print media. Print system 200 includes a controller 202, an ink input supply 212, and printhead 220. Controller 202 may receive print jobs from users, process the print data, and provide marking instructions to printhead 220 which includes a plurality of nozzles 222 that discharge drops of ink 224. Nozzles 222 may have the capability of ejecting a plurality of drop sizes each having a different drop volume from other drops, e.g. none, small, medium and large. During a printing process, image data defines which of nozzles 222 eject ink, thereby converting the image data into print images on web 120.

Controller 202 is enhanced with correction module 210 operable to dynamically determine a quantity of ink used in an ejection by printhead 220. To do this, print system 200 is enhanced with an ink measurement device 216 operable to measure an amount of ink supplied from ink input supply 212 to printhead 220. Ink measurement device 216 may comprise a positive displacement pump operable to trap a fixed amount of ink 214 from input supply 212 and discharge the fixed amount to printhead 220. Ink measurement device 216 may alternatively or additionally comprise a peristaltic pump, a dosing pump, a pump having an on/off cycle rate to provide a constant volume pump per unit time, a flow rate meter, a scale or force cell to measure and/or monitor changes to a mass or volume of ink input supply 212, or other type of pump that enables precise delivery/measurement of fluid input amounts to printhead 220. A sub-tank with a known fill volume, or other fluid measurement systems, devices, pumps, etc. may also be used to accurately gauge and/or deliver an ink input amount at printhead 220. A sub-tank or ink buffer may be located between ink measurement device 216 and printhead 220 to distort the instantaneous correspondence of ejected and measured ink to establish an improved accurate correspondence over time.

Controller 202 is further enhanced with ink output estimator 208 operable to estimate an ink output amount at printhead 220. Ink output estimator 208 may provide ink use predictions for print jobs by analyzing its print data in pieces (e.g., at a page level). For example, ink output estimator 208 may analyze ink drop size values in individual bitmaps of a print job to provide an estimate of ink output by printhead 220 for the print job. An ink drop size may refer to a discrete value that is expected of printhead 220 or nozzle 222 for a particular ink drop type (e.g., none, small, medium, large). Each ink drop size may correspond with or be converted to a unit of quantity, such as volume or mass.

Correction module 210 may analyze information of input/output amounts at printhead 220 to determine changes in ink drop size ejections of printhead 220 or its nozzles 222. Correction module 210 may determine, for example, that printhead 220 or nozzle 222 is ejecting a small ink drop size at a different quantity than previously. Correction module 210 may adapt the estimation process of ink output estimator 208 with changes to ink drop size(s) as print operations are performed, thereby enabling highly accurate print use estimates as compared to assuming constant printhead ejection amounts.

While the specific hardware implementation of controller 202 is subject to design choices, one embodiment may include one or more processors 204 coupled with memory 206. Processor 204 includes any electronic circuits and/or optical circuits that are able to perform functions. For example, processor 204 may be communicatively coupled with components of print system 200 and perform any functionality described herein for controller 202. Processor 204 may include one or more Central Processing Units (CPU), microprocessors, Digital Signal Processors (DSPs), Application-specific Integrated Circuits (ASICs), Programmable Logic Devices (PLD), control circuitry, etc.

Memory 206 may include any electronic circuits, optical circuits, and/or magnetic circuits that are able to store data. For instance, memory 206 may be used to store parameter information regarding the implementation of ink drop size determination in print system 200. Such parameter information may include rules, conditions, etc., for how or when an ejection amount by printhead 220 or one of its nozzles 222 is determined or updated. For example, the parameters used may depend upon a type of print job or print mode, idle times between printing jobs, environmental conditions, user settings, etc. Memory 206 may include one or more volatile or non-volatile Dynamic Random Access Memory (DRAM) devices, FLASH devices, volatile or non-volatile Static RAM devices, magnetic disk drives, Solid State Disks (SSDs), etc. Some examples of non-volatile DRAM and SRAM include battery-backed DRAM and battery-backed SRAM.

Controller 202 may perform various image processing tasks for typical printing operations, such as color management, color separation, color linearization, interpreting, rendering, rasterizing, halftoning, or otherwise converting raw sheet images of a print job into sheetside bitmaps. A bitmap is a two-dimensional array of pixels representing a pattern of ink drops to be applied to web 120 to form an image (or page) of a print job. With a generated bitmap, controller 202 may determine the location and type of every ink drop to be printed for each ink channel and direct printhead(s) 220 accordingly. A type of ink drop may refer to an ink drop size and/or color. For example, each pixel on a bitmap may correspond with a 2-bit value indicating one of four possible firing signals or drop sizes for printhead 220 to eject—none, small, medium, or large.

Although just one printhead 220 is shown for the sake of brevity, print system 200 may be operable with multiple print engines, ink channels, or printheads 220 that apply multiple colored inks such as Cyan (C), Magenta (M), Yellow (Y), and Key (K) black inks. Accordingly, controller 202 may direct/coordinate one or multiple printheads 220, ink input supplies 212, ink measurement devices 216, or some combination thereof. Ink input supply 212, such as a tank or cartridge, may store ink 214 for delivery to one or more printhead(s) 220 via an ink path fluidly coupling printhead(s) 220, ink measurement device(s) 216, and/or ink supplies 212. Ink 214 may comprise any type of fluid that may be jetted from printhead 220, such as colored inks, protector coats, under coats, solvent fluids, cleaning fluids, etc. Printhead 220 may comprise an inkjet printhead such as a Drop-On-Demand (DOD) printhead that uses heating elements or piezoelectric elements to propel ink onto web 120 or a continuous ejection printhead that uses a continuous stream of ink and electrostatic fields to control the placement of the ink onto web 120.

Figure 3:
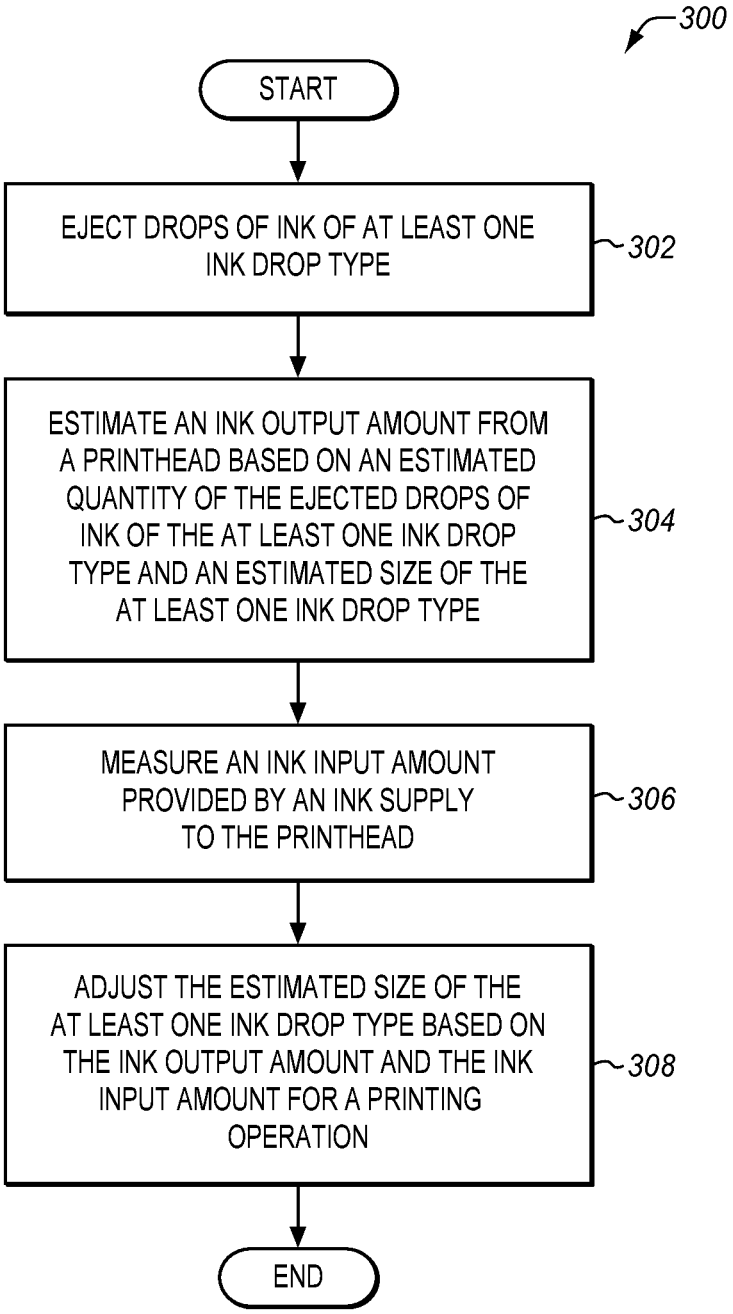
FIG. 3 is a flow chart of a method for determining an estimated size for a type of ink drop ejection for a printhead in an exemplary embodiment.

Additional details will be described with respect to FIG. 3. FIG. 3 is a flow chart of a method 300 for determining an estimated size for a type of ink drop ejection for a printhead in an exemplary embodiment. The flowcharts herein are discussed with respect to print system 200 of FIG. 2, though it will be appreciated that the steps may be performed in other systems, may include other steps not shown, and may be performed in an alternate order.

In step 302, controller 202 directs printhead 220 to eject drops of ink of at least one ink drop type. Thus, controller 202 may command printhead 220 to eject a number of ink drops of corresponding ink drop sizes according to sheet bitmaps of a print job. In doing so, controller 202 may obtain/convert print data such as an Intelligent Printer Data Stream (IPDS), PostScript data, Printer Command Language (PCL), or any other suitable format, into bitmaps for printing to web 120 with printhead(s) 220. The range or number of possible ink drop sizes at printhead 220 may vary in accordance with print mode (e.g., printing resolution), print settings, user settings, parameters in memory 206, etc.

In step 304, ink output estimator 208 estimates an ink output amount from printhead 220 based on an estimated quantity of the ejected drops of ink of the at least one ink drop type and an estimated size of the at least one drop type. Ink output estimator 208 may estimate ink drop count/size information by analyzing bitmap information of a print job or identifying/detecting firing signals or actual ejections for printhead 220. For example, ink output estimator 208 may count a total number of ejections for each drop size and sum, multiply, or otherwise convert the count(s) into a total output quantity for one or multiple printhead(s) 220 using ink drop size values stored in memory 206.

In step 306, ink measurement device 216 measures an ink input amount provided by ink input supply 212 to printhead 220. And, in step 308, correction module 210 adjusts the estimated size of the at least one ink drop type based on the ink output amount and the ink input amount for a printing operation. In doing so, correction module 210 may analyze and compare input/output ink amounts at printhead 220 to determine a change (e.g., in volume, mass, etc.) to a particular ejection ink drop type (e.g., small, medium, large, etc.). As will be discussed in greater detail below, correction module 210 may iteratively determine new drop sizes to calibrate ink output estimator 208 for highly accurate estimates for large print jobs. Additionally, correction module 210 may perform advanced statistical techniques to improve ink use estimation.

Figure 4:
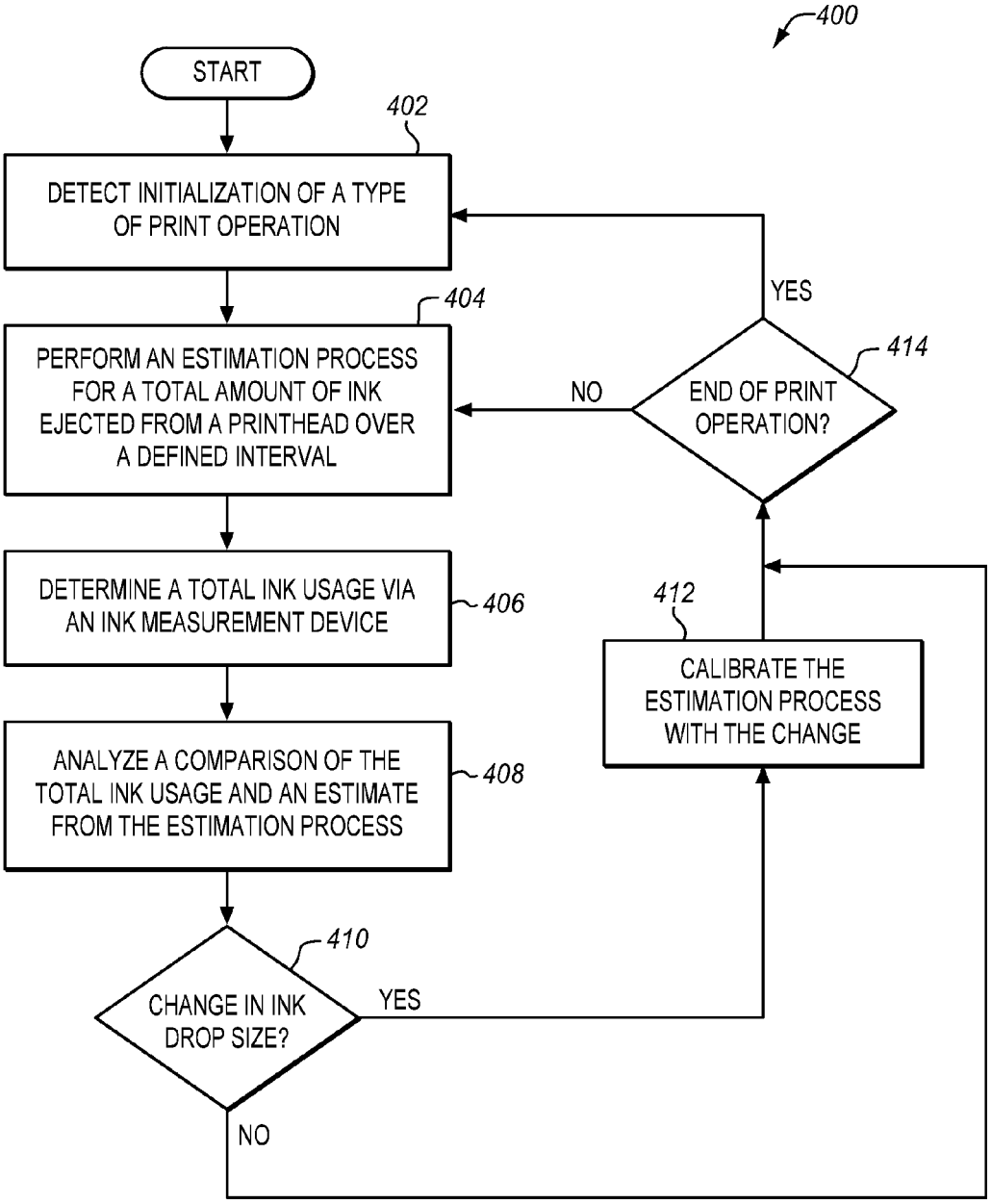
FIG. 4 is a flow chart of a method for calibrating an ink estimation process for a print system an exemplary embodiment.

FIG. 4 is a flow chart of a method for calibrating an ink estimation process for a print system an exemplary embodiment. Assume, for this embodiment, print system 200 receives requests to estimate ink usage for printing prior to actual printing. Parameters defining a request may be received via user input (e.g., from a graphical user interface and/or external devices over a network) or in print data of a print job or associated job ticket and stored in memory 206. Parameters may include, for example, an estimate request for ink amount or cost and/or printing cost for specified print job(s) and/or portions of a print job. A print job may comprise a large collection of multiple jobs serially connected.

In step 402, correction module 210 detects initialization of a type of print operation. Examples of a type of print operation include printing pages, flushing operations, ink recirculation, cleaning events, and maintenance events. Specifications for a print operation, such as frequency, timing, length, etc. may be stored in memory 206 and/or correlated with other print/user settings, print modes, etc.

In step 404, ink output estimator 208 performs an estimation process for the total amount of ink ejected from printhead 220 over an estimation interval. In general, the requested estimate (e.g., for a print job) may comprise multiple estimation intervals. An estimation interval may include a number of bitmap(s), page(s), document(s), print job(s), a print distance, a period of time, a print operation or portion of a print operation, or some combination thereof. Estimation intervals may be defined by a print job or associated job ticket, user input, or associated with other settings in memory 206, such as a print mode (e.g., printing resolution) or a type of print operation. In one embodiment, ink output estimator 208 compiles drop count/size information for each bitmap included within or corresponding to the estimation interval. In another embodiment, ink output estimator 208 estimates ink output at printhead 220 based on a Weibull relationship that relates the optical density versus ink coverage of the printing system.

In step 406, correction module 210 determines a total ink usage via ink measurement device 216. Correction module 210 may monitor or retrieve information from ink measurement device 216 continuously or periodically to determine/calculate the total input amount at printhead 220. In one embodiment, correction module 210 monitors ink measurement device 216 to obtain a number of pump cycles and corresponding cycle amounts (e.g., defined in memory 206 for ink measurement device 216) to calculate ink amounts provided to printhead 220.

In step 408, correction module 210 analyzes a comparison of the total ink usage provided by ink measurement device 216 and the estimate from ink output estimator 208. In one embodiment, correction module 210 performs a regression (e.g., least square regression analysis, lowess localized regression, etc.) to establish a relationship or dependency between the total ink usage and the number of ejected drops, with the drop sizes being unknown. Correction module 210 may be configured to process regression equations that include information of the most recent total ink input and most recent ink output estimate over the estimation interval to identify new values for actual ink drop size. The regression analysis may include known drop size proportions between the drop sizes to reduce the number unknown parameters to be determined in the regression. Alternatively or additionally, correction module 210 may perform a weighted averaging technique (e.g., exponential weighted averaging) so that the amount ejected by the printheads comprises a weighted sum of the amount of ink for each drop size where the weighting is unknown and the number of drops for each drop size is known. Correction module 210 may calculate the weighted sum such that the ink ejected is equal or substantially equal with the amount of measured ink over a span of the same amount of time or printing.

In step 410, correction module 210 determines whether there is a change to one or more ink drop sizes. If so, the process proceeds to step 412 and correction module 210 calibrates the estimation process of the ink output estimator 208. In doing so, correction module 210 may quantify the relationship or dependency established in the regression to identify at least one type of drop size ejected and establish a new amount (e.g., volume, mass, etc.) for the actual drop size. Correction module 210 may error check the new estimated drop sizes and combine additional information to establish new drop sizes to be used in ink usage estimates to represent an improved estimate for drop sizes based on history. Correction module 210 may adjust a quantity value stored in memory 206 that correlates printhead 220, nozzle 222, ink drop size, ejection quantity, etc. using the new estimate for drop sizes.

After calibration, or if correction modules 210 determines in step 410 that ink drop sizes remain unchanged, the process proceeds to step 414 and correction module 210 determines whether the print operation has ended. If the print operation has ended, the process may return to step 402 where correction module 210 awaits detection/initialization of another print operation. Correction module 210 may track, correlate, and calculate ink usage with each print operation to include ink waste in the requested estimate. Waste ink may be ink that is used for cleaning or maintaining printhead nozzles and is not part of the print job data. Waste ink may be accounted for by ink drop counting or in some other manner such as a predetermined amount of ink ejected per distance (e.g., per foot) of processed paper basis for different modes that vary in their ink waste characteristics. Accordingly, correction 210 may perform a regression (e.g., a linear regression) to determine waste ink drop sizes and/or to account for ink waste per print distance (e.g., per foot) or operating time to improve calculating accuracy of an ink drop size quantity. Thus, correction module 210 may calculate/update ink drop volumes for the various ink drop sizes in a manner that is proportional to ink amount used for printing pages while including ink amounts for cleaning, maintenance, etc. in the requested estimate.

Otherwise, if the print operation has not ended at step 414, the process may proceed to step 404 and repeat the steps for another estimation interval. The steps of method 400 may be repeated continuously to iteratively calibrate ink output estimator 208 as printing operations are performed so that requested estimates accurately reflect the state of printing system 200, printhead 220, and nozzles 222 regardless as to variations over time. Additionally, ink measurement device 216 may maintain and provide accurate ink input measurements to printhead 220 as ink output estimator 208 may provide ink estimates in small units (e.g., individual page or bitmap level), enabling print system 200 to continuously update ink use estimates and account for waste ink on a per page basis.

Controller 202 may include an imaging path that transforms the images to be printed including transfer functions for compensation, calibration, and halftoning to convert the image data to a pattern of drops which, when viewed, resemble the image data even though they have been printed using a relatively small set of different drop types. In the halftoning process, the contone level of the transformed image data may be rendered with different sets of drop patterns each designed to achieve varying levels of optical density to represent the tonal levels of the image when printed. The halftoning process may include an algorithm such as "Direct Multibit Search" that generates a stochastic multibit to implement a point operation that uses multiple threshold arrays. For color CMYK printing, controller 202 may use multiple halftones, one for each color and for multiple printheads 220.

In one embodiment, ink output estimator 208 operates in a free standing mode to estimate ink usage down to a page or sheet level by using the existing best drop estimates for a job that is not currently being printed but just being estimated. Ink output estimator 208 may also operate in a learning mode to achieve updated drop sizes and estimates and free standing teaching mode to solely provide estimates. In another embodiment, ink output estimator 208 comprises a duplicate of the entire imaging path (e.g., operations of halftoning, Raster Image Processor (RIP), transfer functions, color management, etc.) without the final printing step. Since the RIP may operate on images imposed on sheets suitable for printing, ink output estimator 208 may provide estimates of ink usage at the page level by summing the volumes of different size drops for the entire sheet. Since the ink output estimator 208 may comprise a faithful simulation of the entire printing process without actually ejecting drops, it may store estimated jobs in memory 206 to avoid re-rasterizing the job at a later time for printing.

Alternatively or additionally, controller 202 may generate a sheetside contone image that does not include the step of halftoning. In this case, the sheetside may be supplied to the print engine and the halftoning may be performed within the print engine which may include drop counters to tally the amount of ink. Alternatively, if the print engine does not include the capability to tally the drops, controller 202 may perform this function using either the ink output estimator 208 running the current job or by providing an additional halftoning operation to the sheetside contone images produced by the rasterization process to tally the printed drops.

In another embodiment, at least one measurement device 216 may be coupled to an auxiliary path to measure fluids for cleaning or maintenance operations. An auxiliary path may aid in recycling jetted ink from a collection gutter to fluid conditioning processes (e.g., filtering, removal of dissolved oxygen, addition of make-up liquid, etc.) and back into the ink system to be combined with the ink originating from the normal ink supply. The auxiliary path may provide a second component of a two part ink system where the added component is a resin used to initiate a cross-linked curing reaction. Such a system may provide an alternate to drying of inks using UV initiated cross-linking. Alternatively or additionally, the auxiliary path may provide ink from a different supplementary ink supply. Correction module 210 may perform the estimation process taking into account calculations for added ink or fluid in the auxiliary paths.

It will be appreciated that actual drop size values may change for a variety of different reasons including subtle changes in ink properties such as viscosity which is influenced by temperature. While highly accurate estimates of the actual drop volumes may achieve accurate estimates of total ink usage to print a job or parts of a job, it may be undesirable to have actual drop volumes that vary significantly from one print system to another. Accurate adjustment of the engine for specific maximum density targets (Dmax) and target tonal response may help achieve consistent ink usage between different printer systems so that each printer (e.g., within a print shop environment) is accurate and consistent.

As described in greater detail in the example below, the steps of method 300 and 400 may be performed for multiple drop size systems, colors, print engines, and printheads.

Example

Assume for this example that print system 200 receives an instruction to estimate ink usage for a print job. Correction module 210 accesses memory 206 to determine parameters for estimating the print job on a per sheet-side or page basis. For each print mode, correction module 210 solves the following equations of each primary color (e.g., CMYK) for the unknown parameters using a least square regression analysis that includes accounting for waste ink. The paper distance in these equations is, for example, the number of feet that corresponds to the processed paper travel distance that the waste ink was applied for the indicated color and waste type. The waste rate in these equations corresponds to the amount of ink ejected per processed paper distance for the indicated ink color and waste type. Waste type is (much like ink drop type is to ink drops) an identifier for the waste ink ejection process selection (e.g. none, small, medium, large). These equations combine the ink from printing and waste ink and equate that amount to the total measured ink usage.

Three Drop Size System:

Total ink usage volume for Black=(black_droptype1_size*black_droptype1_count)+(black_droptype2_size*black_droptype2_count)+(black_droptype3_size*black_droptype3_count) Equation (1):

Total ink usage volume for Cyan=(cyan_droptype1_size*cyan_droptype1_count)+(cyan_dropsize2_size*cyan_droptype2_count)+(cyan_droptype3_size*cyan_droptype3_count) Equation (2):

Total ink usage volume for Magenta=(magenta_droptype1_size*magenta_droptype1_count)+(magenta_droptype2_size*magenta_droptype2_count)+(magenta_droptype3_size*magenta_droptype3_count) Equation (3):

Total ink usage volume for Yellow=(yellow_droptype1_size*yellow_droptype1_count)+(yellow_droptype2_size*yellow_droptype2_count)+yellow_droptype3_size*yellow_droptype3_count) Equation (4):

A two drop size system and one waste ink type is presented below. Here, waste ink is accounted for by waste type's ejection rate (amount of ink per paper linear distance) and the processed paper linear distance:

Total ink usage volume for Black=(black_droptype5_size*black_droptype5_count)+(black_droptype6_size*black_droptype6_count)+(black_wastetype7_rate*black_waste_type7_distance) Equation (5):

Total ink usage volume for Cyan=(cyan_droptype5_size*cyan_droptype5_count)+(cyan_droptype6_size*cyan_droptype6_count)+(cyan_wastetype7_rate*cyan_waste_type7_distance) Equation (6):

Total ink usage volume for Magenta=(magenta_droptype5_size*magenta_droptype5_count)+(magenta_droptype6_size*magenta_droptype6_count)+(magenta_wastetype7_rate*magenta_waste_type7_distance) Equation (7):

Total ink usage volume for Yellow (yellow_droptype5_size*yellow_droptype5_count)+(yellow_droptype6_size*yellow_droptype6_count)+(yellow_wastetype7_rate*yellow_waste_type7_distance) Equation (8):

Correction module 210 may update the drop volumes for the various ink drop sizes and confirm that any ink drop volume changes are small and consistent with the allowable range from statistical analysis of the variability of drop sizes. Additionally, correction module 210 may update other volumes associated with other ejection modes, such as maintenance or waste ink ejected per linear paper advancement distance, in memory 206. In the case where an auxiliary path is used, which may involve additional measurement devices 216, the added ink or fluid may be accounted for mathematically in the estimation process. If the path of the recycled fluid in the auxiliary path involves adding fluid back into the ink supply path in ahead of the main measurement device for the ink supply, the measured amount of ink in the auxiliary path may be subtracted from the total ink usage measured by ink measurement device 216, to obtain a modified total ink usage. This is to account for the fact that the ink in this path was recycled and therefore not applied to the paper media of a user's print job. The modified total ink usage may then be used in the previous equations, instead of total ink usage volume. A case might also occur where fluid is added to the ink path after the ink measurement device 216, for some type of additive fluid such as a two component fluid system. In this second case the modified total ink usage may comprise the sum of the ink usage as measured by device 216 and the fluid usage in the auxiliary path as measured by another ink measurement device. The modified total ink may then be used in the previous equations instead of total ink usage volume shown in the original equations.

Employing accurate values for the drop sizes in the system result in accurate estimates for the ink usage at any level desired, including the page level. Controller 202 may report a requested estimate or ink drop sizes to another device (e.g., via a network, wireless interface, etc.) or to a user via a graphical user interface of print system 200. Information of the amount may be provided as a total volume, rate, cost, etc.

Any of the various elements shown in the figures or described herein may be implemented as hardware, software, firmware, or some combination of these. For example, an element may be implemented as dedicated hardware. Dedicated hardware elements may be referred to as "processors", "controllers", or some similar terminology. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, a network processor, application specific integrated circuit (ASIC) or other circuitry, field programmable gate array (FPGA), read only memory (ROM) for storing software, random access memory (RAM), non-volatile storage, logic, or some other physical hardware component or module.

Also, an element may be implemented as instructions executable by a processor or a computer to perform the functions of the element. Some examples of instructions are software, program code, and firmware. The instructions are operational when executed by the processor to direct the processor to perform the functions of the element. The instructions may be stored on storage devices that are readable by the processor. Some examples of the storage devices are digital or solid-state memories, magnetic storage media such as a magnetic disks and magnetic tapes, hard drives, or optically readable digital data storage media.

Figure 5:
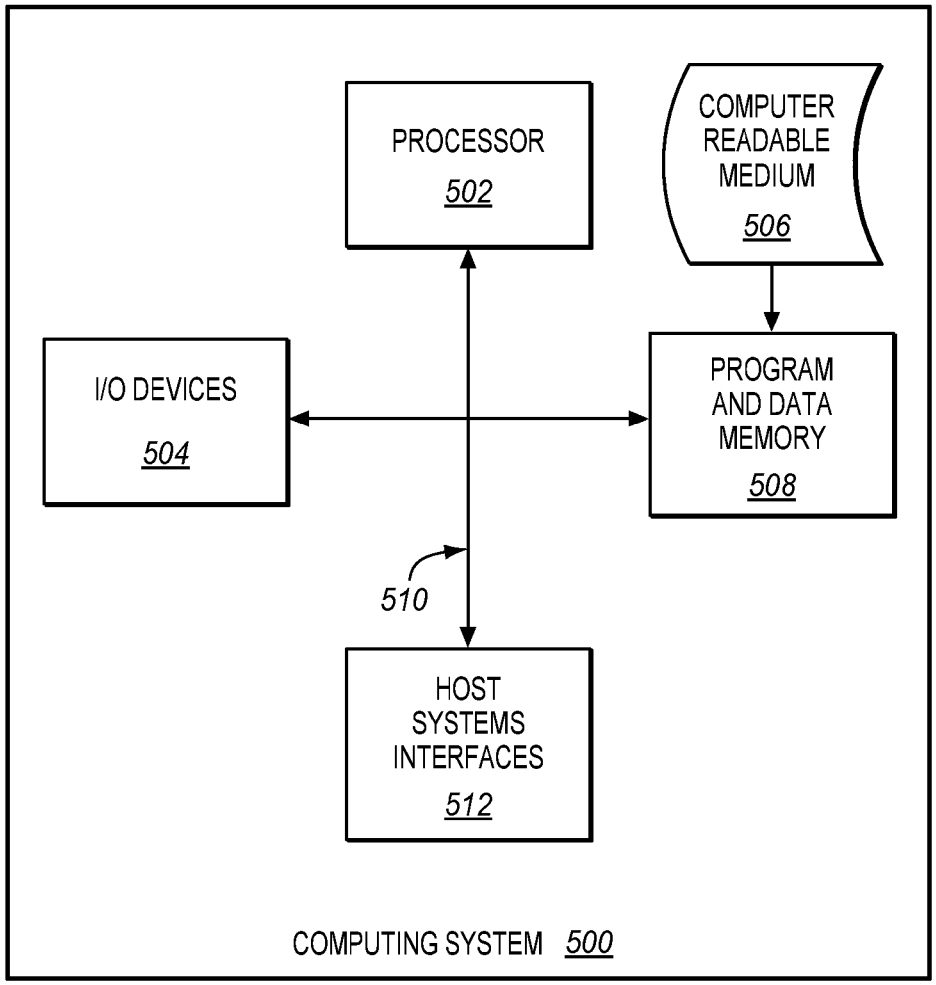
FIG. 5 illustrates a computing system in which a computer readable medium may provide instructions for performing any of the functionality disclosed herein for the embodiments described herein.

In one embodiment, functions described herein are implemented in software, which includes but is not limited to firmware, resident software, microcode, etc. FIG. 5 illustrates a computing system 500 in which a computer readable medium 506 may provide instructions for performing any of the functionality disclosed herein for controller 102.

Furthermore, the invention can take the form of a computer program product accessible from computer readable medium 506 that provides program code for use by or in connection with a processor or any instruction execution system. For the purposes of this description, computer readable medium 506 can be any apparatus that can tangibly store the program for use by or in connection with the instruction execution system, apparatus, or device, including computing system 500.

Computer readable medium 506 can be any tangible electronic, magnetic, optical, electromagnetic, infrared, or semiconductor system (or apparatus or device). Examples of computer readable medium 506 include a semiconductor or solid state memory, magnetic tape, a removable computer diskette, a random access memory (RAM), a read-only memory (ROM), a rigid magnetic disk and an optical disk. Some examples of optical disks include compact disk-read only memory (CD-ROM), compact disk-read/write (CD-R/W) and DVD.

Computing system 500, suitable for storing and/or executing program code, can include one or more processors 502 coupled directly or indirectly to memory 508 through a system bus 510. Memory 508 can include local memory employed during actual execution of the program code, bulk storage, and cache memories which provide temporary storage of at least some program code in order to reduce the number of times code is retrieved from bulk storage during execution. Input/output or I/O devices 504 (including but not limited to keyboards, displays, pointing devices, etc.) can be coupled to the system either directly or through intervening I/O controllers. Network adapters may also be coupled to the system to enable computing system 500 to become coupled to other data processing systems, such as through host systems interfaces 512, or remote printers or storage devices through intervening private or public networks. Modems, cable modem and Ethernet cards are just a few of the currently available types of network adapters.

Although specific embodiments were described herein, the scope is not limited to those specific embodiments. Rather, the scope is defined by the following claims and any equivalents thereof.

The invention claimed is:

1. A system comprising:

at least one inkjet printhead fluidly coupled to an ink input supply;

a controller configured to direct the at least one inkjet printhead to eject drops of ink of multiple ink drop types;

memory configured to store a size value for each the multiple ink drop types that represents a directed ink drop size to eject, wherein the size value is different for each of the multiple ink drop types;

an ink output estimator configured to estimate an ink output amount ejected from the at least one inkjet printhead based on an estimated quantity of each of the multiple ink drop types ejected from the at least one printhead and the size value of each of the multiple ink drop types;

an ink measurement device configured to measure an ink input amount provided by the ink input supply to the at least one inkjet printhead; and a correction module configured to compare the ink input amount with the ink output amount for a printing operation, to detect an error in the size value for at least one of the multiple ink drop types based on a discrepancy in the comparison between the ink input amount from the ink input supply and the ink output amount from the estimated quantity and the size value of each of the multiple ink drop types, and to adjust the size value in the memory for the at least one of the multiple ink drop types based on the discrepancy.

2. The system of claim 1 wherein:

the ink output estimator configured to perform an estimation process for the ink output amount ejected from the at least one printhead based on bitmaps of a print job; and the correction module is configured to calibrate the estimation process based on updates to the size value in the memory for the at least one of the multiple ink drop types as the bitmaps print.

3. The system of claim 1 wherein:

the ink measurement device comprises a positive displacement pump configured to monitor a number of pump cycles and corresponding cycle amounts of ink provided from the ink input supply to the at least one inkjet printhead; and the correction module is configured to determine the ink input amount based on the number of pump cycles and the cycle amounts over a period of time, to perform a regression to establish a dependency between the ink input amount and the ink output amount over the period of time, and to update an estimation process of the ink output estimator with a change to the size value in the memory for the at least one of the multiple ink drop types of the at least one inkjet printhead.

4. The system of claim 3 wherein:

the correction module is configured to perform the regression using drop size proportions between the multiple ink drop types.

5. The system of claim 1 wherein:

the correction module is configured to detect the error in the size value for at least one of the multiple ink drop types based on the discrepancy in the comparison over a predetermined number of documents in a print job.

6. The system of claim 1 further comprising:

an auxiliary ink measurement device configured to measure an auxiliary ink path ink amount;

wherein the correction module adjusts the ink input amount by the auxiliary ink path ink amount.

7. The system of claim 1 wherein:

the correction module is configured to adjust the size value in memory for the at least one of the multiple ink drop types for multiple inkjet printheads.

8. A method comprising:

directing at least one inkjet printhead to eject drops of ink of multiple ink drop types;

storing, in memory, a size value for each the multiple ink drop types that represents a directed ink drop size to eject, wherein the size value is different for each of the multiple ink drop types;

estimating an ink output amount ejected from the at least one inkjet printhead based on an estimated quantity of each of the multiple ink drop types ejected from the at least one printhead and the size value of each of the multiple ink drop types;

measuring an ink input amount provided by an ink input supply to the at least one inkjet printhead;

comparing the ink input amount with the ink output amount for a printing operation;

detecting an error in the size value for at least one of the multiple ink drop types based on a discrepancy in the comparison between the ink input amount from the ink input supply and the ink output amount from the estimated quantity and the size value of each of the multiple ink drop types; and adjusting the size value in the memory for the at least one of the multiple ink drop types based on the discrepancy.

9. The method of claim 8 further comprising:

performing an estimation process for the ink output amount ejected from the at least one inkjet printhead based on bitmaps of a print job; and calibrating the estimation process based on updates to the size value in memory for the at least one of the multiple ink drop types.

10. The method of claim 8 further comprising:

monitoring, with a positive displacement pump, a number of pump cycles and corresponding cycle amounts of ink provided from the ink input supply to the at least one inkjet printhead;

determining the ink input amount based on the number of pump cycles and the cycle amounts over a period of time;

performing a regression to establish a dependency between the ink input amount and the ink output amount over the period of time; and updating an estimation process of the ink output estimator with a change to the size value in the memory for the at least one of the multiple ink drop types of the at least one inkjet printhead.

11. The method of claim 10 further comprising:

performing the regression using drop size proportions between the multiple ink drop types.

12. The method of claim 8 further comprising:

detecting the error in the size value for at least one of the multiple ink drop types based on the discrepancy in the comparison over a predetermined number of documents in a print job.

13. The method of claim 8 further comprising:

measuring an auxiliary ink path ink amount with an auxiliary ink measurement device; and adjusting the ink input amount by the auxiliary ink path ink amount.

14. The method of claim 8 further comprising:

adjusting the size value in memory for the at least one of the multiple ink drop types for multiple inkjet printheads.

15. A non-transitory computer readable medium embodying programmed instructions which, when executed by a processor, direct the processor to:

direct at least one inkjet printhead to eject drops of ink of multiple ink drop types;

store, in memory, a size value for each the multiple ink drop types that represents a directed ink drop size to eject, wherein the size value is different for each of the multiple ink drop types;

estimate an ink output amount ejected from the at least one inkjet printhead based on an estimated quantity of each of the multiple ink drop types ejected from the at least one printhead and the size value of each of the multiple ink drop types;

measure an ink input amount provided by an ink input supply to the at least one inkjet printhead;

compare the ink input amount with the ink output amount for a printing operation;

detect an error in the size value for at least one of the multiple ink drop types based on a discrepancy in the comparison between the ink input amount from the ink input supply and the ink output amount from the estimated quantity and the size value of each of the multiple ink drop types; and adjust the size value in the memory for the at least one of the multiple ink drop types based on the discrepancy.

16. The non-transitory computer readable medium of claim 15, wherein the instructions further direct the processor to:

perform an estimation process for the ink output amount ejected from the at least one printhead based on bitmaps of a print job; and calibrate the estimation process based on updates to the size value in memory for the at least one of the multiple ink drop types.

17. The non-transitory computer readable medium of claim 15, wherein the instructions further direct the processor to:

monitor, with a positive displacement pump, a number of pump cycles and corresponding cycle amounts of ink provided from the ink input supply to the at least one inkjet printhead;

determine the ink input amount based on the number of pump cycles and the cycle amounts over a period of time;

perform a regression to establish a dependency between the ink input amount and the ink output amount over the period of time; and update an estimation process of the ink output estimator with a change to the size value in the memory for the at least one of the multiple ink drop types of the at least one inkjet printhead.

18. The non-transitory computer readable medium of claim 17, wherein the instructions further direct the processor to:

perform the regression using drop size proportions between the multiple ink drop types.

19. The non-transitory computer readable medium of claim 15, wherein the instructions further direct the processor to:

detect the error in the size value for at least one of the multiple ink drop types based on the discrepancy in the comparison during printing of a predetermined number of documents in a print job.

20. The non-transitory computer readable medium of claim 15, wherein the instructions further direct the processor to:

measure an auxiliary ink path ink amount with an auxiliary ink measurement device; and adjust the ink input amount by the auxiliary ink path ink amount.

* * * * *